United States Patent [19]

Roccaforte et al.

[11] 4,239,104

[45] Dec. 16, 1980

[54] GLUED FOLDER

[75] Inventors: Harry I. Roccaforte, Western Springs; Irvin W. Sherwood, Downers Grove, both of Ill.

[73] Assignee: Champion International Corporation, Stamford, Conn.

[21] Appl. No.: 60,760

[22] Filed: Jul. 26, 1979

[51] Int. Cl.[3] ..... B65D 65/16; B65D 85/68

[52] U.S. Cl. ..... 206/45.33; 206/335; 206/491; 229/87 R

[58] Field of Search ..... 206/45.33, 45.14, 45.19, 206/335, 491, 526, 294, 295, 806; 229/87 R

[56] References Cited

U.S. PATENT DOCUMENTS

| | | | |
|---|---|---|---|
| 2,026,626 | 1/1936 | Gilfillan | 206/45.33 |
| 2,289,236 | 7/1942 | Broderick | 206/45.19 |
| 2,415,151 | 2/1947 | Taylor et al. | 206/491 |
| 2,566,667 | 9/1951 | Krihwan | 206/295 |
| 3,184,057 | 5/1965 | Kidd, Jr. | 206/294 |
| 3,814,235 | 6/1974 | Glaze, Jr. | 206/292 |

*Primary Examiner*—William T. Dixon, Jr.
*Attorney, Agent, or Firm*—Evelyn M. Sommer

[57] ABSTRACT

A glued folder includes pockets at the opposed ends thereof for engaging the opposed ends of an elongated product to be packaged and displayed. The glued folder is formed from a single paperboard blank, having a bottom panel, as well as side panels folded and bonded along the rear surface of a main display panel, with the latter including slots such that a portion of the main display panel at each opposed end thereof cooperates with the other panels to define the pockets. The folder is secured by a single strip of adhesive applied to one side panel.

21 Claims, 10 Drawing Figures

GLUED FOLDER

The subject invention relates to a new and improved glued folder intended to be used to ship and display elongated products, such as windshield wiper blades. More particularly, the subject invention relates to a glued folder formed from a single sheet having four panels which are folded together to form an envelope-type configuration, with only one gluing step being required to seal the folder.

Folders found in the prior art require that both their ends be individually glued, thus necessitating the sequential or timed application of adhesive at spaced locations (usually at the opposite ends of the folder). This type of timing sequence requires that automatic gluing equipment operate intermittently and at a substantially reduced speed to avoid misapplication of the adhesive, thus reducing the number of folders that can be produced in a given time.

Accordingly, it is an object of the subject invention to provide a new and improved glued folder where a single strip of adhesive is applied along one edge thereof, in a continuous untimed operation, thus allowing the folder to be produced at a higher speed, and at reduced cost.

It is a further object of the subject invention to provide a glued folder that can be manufactured with greater efficiency at lower cost.

It is still a further object of the subject invention to provide a glued folder which is of uniform thickness and to which adhesive is applied in an untimed operation.

Further objects and advantages of the subject invention will become apparent from the following detailed description taken in conjunction with the drawings in which.

Figure 1:
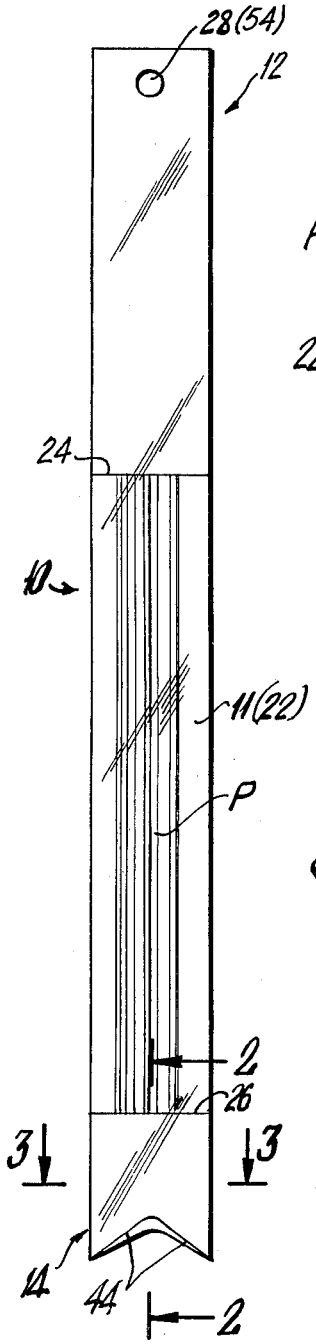
FIG. 1 is a front elevational view of the folder of the subject invention illustrating the packaging and display of an elongated product.

Referring to FIG. 1, the glued folder of the subject invention is generally designated by the number 10 and is intended for the packaging and display of an elongated product P, such as windshield wiper blades. The glued folder 10 is preferably formed from a single sheet of cardboard blank, and is of an elongated, generally envelope-type configuration, the dimensions of which may be varied according to the product to be displayed. The folder is shown with a shrink wrap covering 11, which envelopes the entire folder and the product therein to protect the product, as is common in the industry. In the erected folder, closed pockets 12 and 14 are provided such that the opposed ends of the product to be displayed are received therein to securely hold the product P, as more fully described hereinafter.

Figure 4:
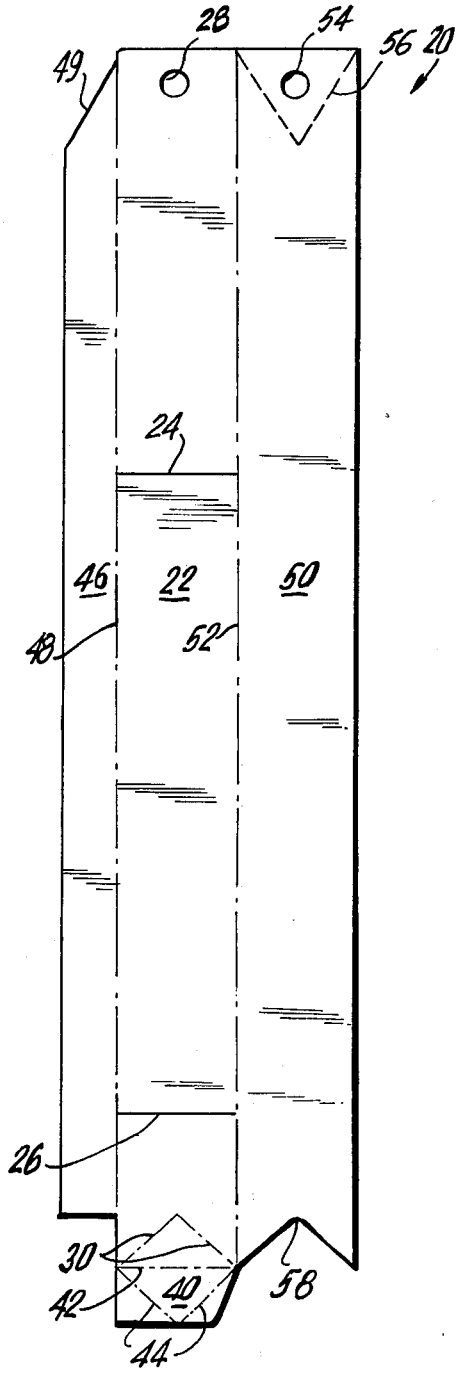
FIG. 4 is a plan view of the blank for forming the glued folder of the subject invention.

FIG. 4 illustrates blank 20 for forming the glued folder of the subject invention. Blank 20 includes a main display panel 22 of generally elongated, rectangular configuration. The main display panel 22 includes first and second slots 24 and 26 extending across the entire width thereof, and disposed adjacent and spaced from the opposed edges of the main display panel 22 for receiving the opposite ends of the product to be displayed. In the preferred embodiment, first slot 24 is spaced at a greater distance from the upper edge of panel 22 than the spacing of slot 26 from the lower edge of panel 22 so that upper pocket 12 is larger than lower pocket 14. This arrangement facilitates the insertion of product P into the folder as more fully described hereinafter. A generally circular aperture 28 is provided in the upper portion of the main display panel 22 for hanging the glued folder on a hook or rack while on display. Generally triangular fold lines 30 are provided at the bottom end of the main display panel 22 to allow for enlargement of closed pocket 14 of the folder 10 to facilitate insertion of the product therein.

A lower panel 40 is hingedly connected to the bottom edge of main display panel 22 along fold line 42. Lower panel 40 is also provided with triangular fold lines 44 to facilitate the enlargement of the lower closed pocket 14 of the folder 10 for insertion of the elongated product. A side panel 46 is hingedly connected to the main display panel 22 along fold line 48. As illustrated in FIG. 4, the lower edge of side panel 46 terminates short of the lower edge of main display panel 22 such that the lower panel 40 will not overlap the side panel 46 in the sealed folder 10 which results in the lower end of the folder having an even or uniform thickness. In addition, the upper edge of side panel 46 has an angled cut away portion 49 to permit the sealing of the top of the folder as more fully described hereinafter.

Figure 5:
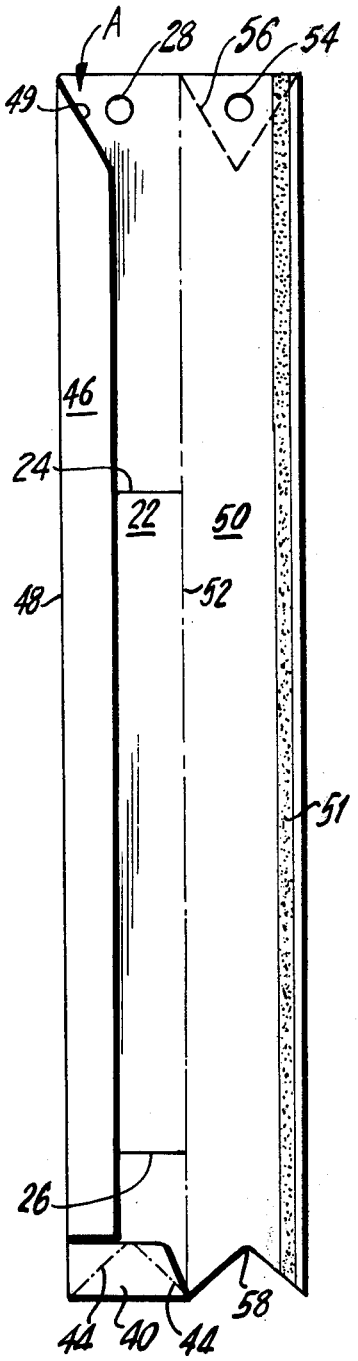
FIG. 5 is an elevational view of the partially erected glued folder of the subject invention.

A back panel 50 is hingedly connected to the main display panel 22 along fold line 52. An adhesive strip 51 is applied along the outer edge of the back panel 50 for sealing the folder (see FIG. 5). Since the adhesive 51 is applied to only one panel in a continuous untimed operation, the folder can be produced at a higher speed, thereby reducing the manufacturing cost. A circular aperture 54 is disposed adjacent the top edge of back panel 50 such that aperture 54 is aligned with aperture 28 in the sealed folder. Triangular shaped fold lines 56 are provided at the upper edge of back panel 50 to permit the top of the folder to close when the product inside extends nearly to the top, as more fully described hereinafter. A generally triangular-shaped cut out 58 is provided at the lower end of the back panel 50 to facilitate the enlargement of the closed pocket 14.

The folder 10 is erected by folding the lower panel 40 inwardly along fold line 42, and then by inwardly folding the side panel 46 along fold line 48. Since the side panel 46 does not extend to the lower edge of the main display panel 22, it does not overlap the lower panel 40 thus allowing the folder to be of uniform thickness (see FIG. 5). Finally, the back panel 50 is folded inwardly along fold line 52 and is joined to the lower and side panels 40 and 46, by means of the adhesive strip 51. In addition, back panel 50 is adhesively joined (at arrow A) to the rear surface of front panel 22, near the top edge thereof, adjacent the cut away portion 49 of side panel 46 thereby sealing the top of the folder.

Figure 2:
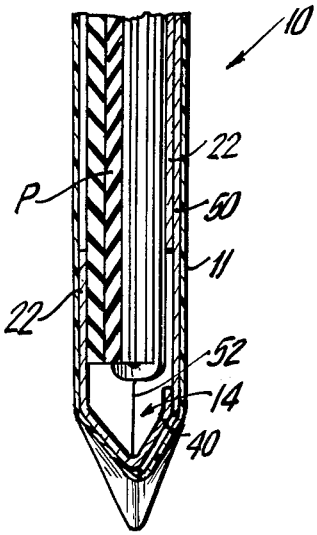
FIG. 2 is a cross-sectional view of the lower portion of the folder, taken along line 2—2 in FIG. 1.
Figure 3:
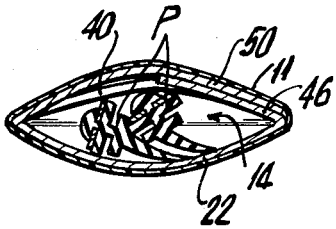
FIG. 3 is a cross-sectional view of the lower portion of the folder, taken along line 3—3 in FIG. 1.

The portions of the main display panel between the slots 24 and 26 and the associated ends cooperate with the back panel 50, the side panel 46 and the lower panel 40 to form closed pockets for holding the ends of the elongated product to be displayed (see FIGS. 2 and 3). Loading of the product P is accomplished by inserting one end of the product through first slot 24 and into upper pocket 12. The additional length of upper pocket 12 allows enough of product 12 to be inserted therein such that the lower edge of product P is raised above second slot 26, whereupon it may be inserted in the lower pocket 14. The weight of the product P forces the product to rest in the lower pocket 14, while the thickness of the product P will cause the lower portion of the folder to expand. (see FIG. 3). The triangular fold lines 30 and 44 increase the flexibility of the paperboard, thereby facilitating the enlargement of the lower pocket 14. The additional length of upper pocket 12 is also provided to allow for adequate clearance so that aligned apertures 28, 54 are not obstructed, thereby permitting the product to be displayed by hanging the folder from the apertures. The product P can be displayed in the folder with or without additional shrink wrap film as is common in the industry.

Figure 7:
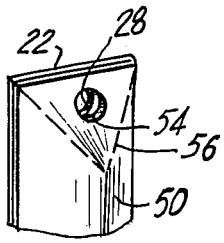
FIg. 7 is a rear perspective view of the upper portion of the folder illustrated in FIG. 1.

In applications where product P extends nearly the length of folder 10, it is necessary, when inserting the product into upper pocket 12, to separate the adhesively joined front and back panels 22, 50. Since front and back panels 22 and 50 are only joined at point A (see FIG. 5), the insertion of product P past point A will easily separate the panels allowing the product to emerge from the top of the folder, thereby permitting the lower edge of the product to be raised past second slot 26. When the front and back panels have been separated, it is preferable to enclose the folder in a shrink wrap film to facilitate containment of the product therein. Fold lines 56 are provided at the upper edge of panel 50 so that the triangular segment can be folded inwardly (see FIG. 7) to close any gap formed between the front and back panels 22, 50, thus facilitating the film shrinking operation.

Figure 6:
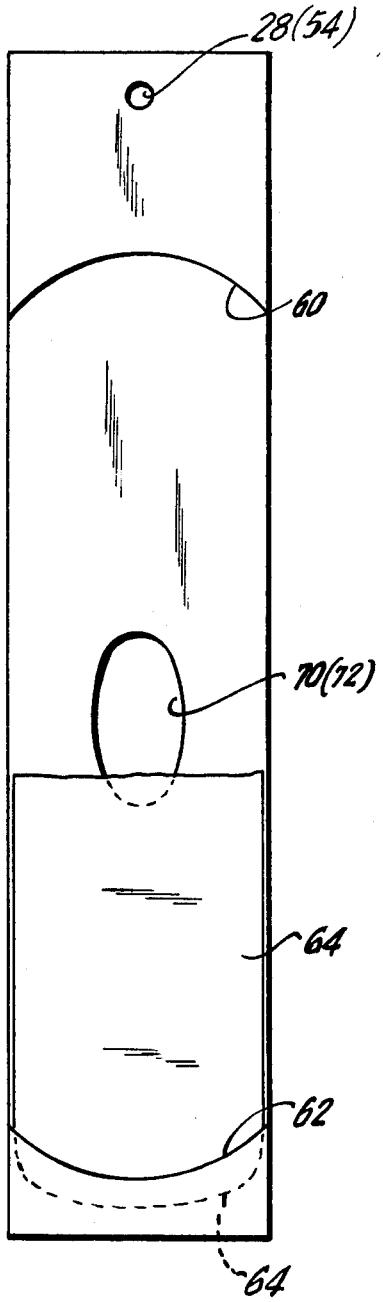
FIG. 6 is a front elevational view of a second embodiment of the subject invention.

In the second embodiment of the subject invention, as illustrated in FIG. 6, slots 60 and 62 extend across the entire width of the main display panel and have an arcuate configuration, with each convex side respectively disposed adjacent the associated edge of the main display panel 22. The configuration of the slots 60 and 62 substantially conform to the configuration of the ends of the product 64, as used in this embodiment. In addition, registered apertures 70 and 72 are provided in the main display panel 22 and the back panel 50 to allow viewing of the product from the rear of the folder. Folding, gluing and insertion of the product are accomplished in the same manner as described above.

Figure 8:
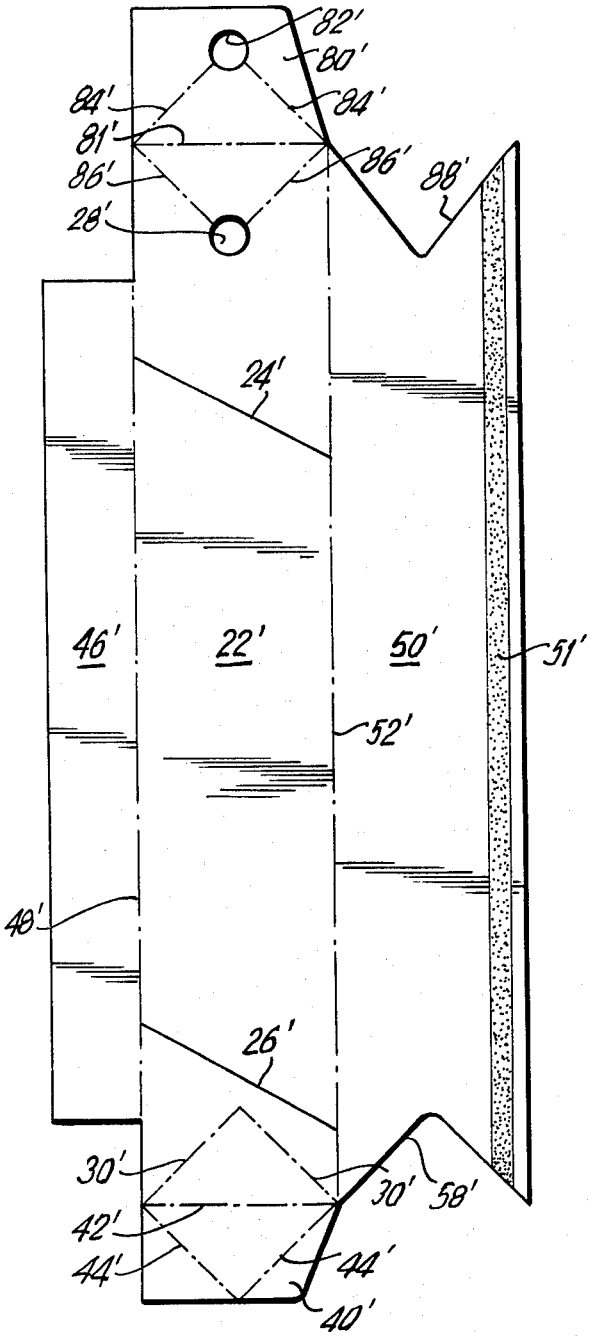
FIG. 8 is a plan view of a blank illustrating a third embodiment of the glued folder of the subject invention.
Figure 9:
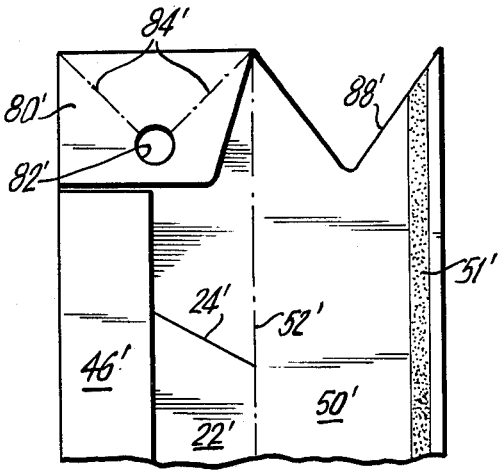
FIG. 9 is an elevational view of the upper portion of the partially erected folder illustrated in FIG. 8.
Figure 10:
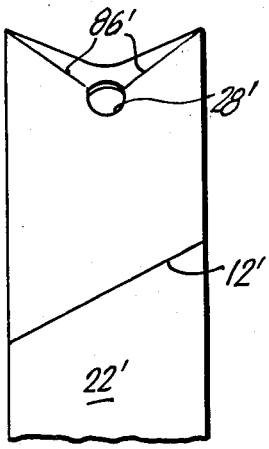
FIG. 10 is a front elevational view of the upper portion of the erected glued folder illustrated in FIG. 8.

FIGS. 8–10 illustrate a third embodiment of the subject invention. This embodiment is useful when it is desired to fully seal both the top and the bottom of the folder. In this embodiment, the upper portion of the folder is arranged as the mirror image of the lower portion of the first embodiment. More particularly, an upper panel 80' is provided similar to lower panel 40' and is hingedly connected to the main display panel 22' along fold line 81'. Upper panel 80' is additionally provided with an aperture 82' disposed to be in register with the aperture 28' of the main display panel 22' in the erected folder, thereby permitting the product to be displayed by hanging the folder from the apertures. Triangularly shaped fold lines 84' and 86' are provided in the upper panel 80' and main display panel 22' respectively, to increase the flexibility of the paperboard, thereby facilitating the enlargement of the upper closed pocket 12', as illustrated in FIG. 10, to aid in the insertion of the product. As clearly seen in FIG. 9, side panel 46' terminates short of the upper edge of the main display panel 22' such that the lower edge of the upper panel 80' will not overlap the side panel 46' in the sealed folder. This arrangement results in the upper end of the folder having an even or uniform thickness.

In addition, back panel 50' is provided with a generally triangular shaped cut out 88' to facilitate the enlargement of the upper pocket 12', and to leave the registered apertures 28' and 82' unobstructed. This embodiment of the subject invention is sealed by folding the upper and lower panels 40' and 80' about their respective hinge lines, 42' and 81', and side panel 46' is folded about hinge line 48'. Back panel 50' is folded about hinge line 52' and is adhesively joined to the upper, lower and side panels 80',40',46', along glue strip 51'. As noted above, this embodiment of the glued folder of the subject invention provides for the complete sealing of both the upper and lower pockets, thereby protecting the product from slipping out of either end.

Accordingly, there is provided a new and improved glued folder for packaging, shipping and display of products. The glued folder is manufactured with adhesive applied to only one panel in a continuous untimed operation, and thus, the glued folder is capable of being produced at a high speed, thereby reducing the cost of manufacture. In addition, the upper and lower portions of the side panel of the folder is configured such that the folder has uniform thickness.

The present invention has been described in the above specification with reference to specific embodiments, and such references have been made for purely illustrative purposes and various modifications in the details included therein may be made without departing from the scope or spirit of the invention as will be obvious to those skilled in the art.

What is claimed is:

1. A glued folder forming a generally envelope-type structure for packaging and display of an elongated product comprising:

a main display panel with top, bottom and side edges;

a lower panel hingedly connected to the bottom edge of said main display panel and disposed parallel thereto;

a side panel hingedly connected to one edge of said main display panel and disposed parallel thereto, said side panel extending from the top edge of said bottom panel to the top edge of said main display panel;

a back panel hingedly connected to the opposite edge of said main display panel and disposed parallel thereto, said back panel being adhesively connected along the inner surface thereof to the outer surface of said side and lower panels; and said main display panel having upper and lower slots extending across the entire width and respectively spaced from the top and bottom edges thereof, with the portions of said main display panel extending between each slot and the associated top or bottom edges thereof cooperating with the back, side, and lower panels to form upper and lower closed pocket portions at the opposite ends of said folder, whereby the opposed ends of the elongated product may be received in said closed pocket portions, with the intermediate portion of said product being disposed adjacent the front surface of said main display panel, said folder thereby securely holding the product and allowing for the display of said product.

2. A glued folder as in claim 1 wherein the distance between said upper slot and the top edge of said main display panel is greater than the distance between said lower slot and the bottom edge of said main display panel, such that said upper pocket portion is longer than said lower pocket portion to facilitate the insertion of the elongated product therein.

3. A glued folder as in claim 1 wherein said lower panel and said main display panel, further include generally triangular-shaped opposed embossed fold lines, to provide increased flexibility of the folder in the region of said lower closed pocket portion, thus allowing said lower pocket portion to be enlarged to facilitate insertion of said elongated product therein.

4. A glued folder as in claim 1, wherein said back panel includes generally triangular-shaped fold lines adjacent the top edge thereof to provide increased flexibility of the back panel to facilitate the closure of the top portion of the folder.

5. A glued folder as in claim 1, wherein said side panel includes an angled cut away portion adjacent the upper edge thereof to permit said back panel to be adhesively joined to the rear surface of said main display panel thereby sealing the upper end of said folder.

6. A glued folder as in claim 1 wherein said main display panel includes a first aperature disposed adjacent the top edge thereof and wherein said back panel includes a second aperture disposed adjacent the top edge thereof, and aligned with said first aperture for enabling said folder to be carried on a support hook.

7. A glued folder as in claim 1 wherein said folder is formed from a single sheet of cardboard blank.

8. A glued folder as in claim 1 wherein said slots are arcuate in configuration, with each convex side respectively disposed adjacent the associated edge, and wherein both said main display panel and said back panel include central apertures which are aligned to permit viewing of said elongated product from the rear of said folder.

9. A glued folder as in claim 1 wherein the length and the width of said back panel is equal to the length and the width of said main display panel.

10. A glued folder as in claim 1 further including an upper panel, hingedly connected to the top edge of said main display panel and disposed parallel and adjacent thereto, with said back panel being adhesively connected along the inner surface thereof to the outer surface of said upper panel, said upper panel for aiding in sealing said upper closed pocket portion of said folder.

11. A glued folder as in claim 10 wherein said side panel includes a rectangular cut-away portion adjacent the upper edge thereof such that the upper edge of said side panel extends to the lower edge of said upper panel, thereby providing the upper closed pocket portion of said folder with a uniform thickness.

12. A glued folder as in claim 10 wherein said upper panel and said main display panel further include generally triangular-shaped opposed embossed fold lines, to provide increased flexibility for the folder in the region of said upper closed pocket portion, thus allowing said upper closed pocket portion to be enlarged to facilitate insertion of said elongated product therein.

13. A glued folder as in claim 10 wherein said back panel further includes generally triangular shaped cut-out portions adjacent the top and bottom edge thereof to facilitate the enlargement of said closed pocket portions.

14. In combination with an elongated product, a glued folder forming a generally envelope-type structure for packaging and display of said elongated product comprising:

a main display panel with top, bottom and side edges;

a lower panel hingedly connected to the bottom edge of said main display panel and disposed parallel thereto;

a side panel hingedly connected to one edge of said main display panel and disposed parallel thereto, said side panel extending from the top edge of said bottom panel to the top edge of said main display panel;

a back panel hingedly connected to the other edge of said main display panel and disposed parallel thereto, said back panel being adhesively connected along the inner surface thereof to the outer surface of said side and lower panels;

said main display panel including upper and lower slots extending across the entire width and respectively spaced from the top and bottom edges thereof, with the portions of said main display panel extending between each slot and the associated top or bottom edges thereof cooperating with the back, side and lower panels to form closed upper and lower pocket portions, with the opposed ends of the elongated product being received in said closed pocket portions, while the intermediate portion of said product is disposed on the front surface of said main display panel, said folder thereby securely holding the product and allowing for the display of said product; and a covering of a clear plastic film enveloping the entire folder and product therein for protecting said product.

15. A glued folder as in claim 14 wherein the distance between said upper slot and the top edge of said main display panel is greater than the distance between said lower slot and the bottom edge of said main display panel, such that said upper pocket portion is longer than said lower pocket portion to facilitate the insertion of the elongated product therein.

16. A glued folder as in claim 14 wherein said lower panel and said main display panel further include generally triangular-shaped opposed embossed fold lines, to provide increased flexibility of the folder in the region of said lower closed pocket portion, thus allowing said lower pocket portion to be enlarged to facilitate insertion of said elongated product therein.

17. A glued folder as in claim 14 wherein said back panel includes generally triangular-shaped fold lines adjacent the top edge thereof to provide increased flexibility of the back panel to facilitate the sealing of the top portion of the folder.

18. A glued folder as in claim 14 wherein said side panel includes an angled cut away portion adjacent the upper edge thereof to permit said back panel to be adhesively joined to the rear surface of said main display panel thereby sealing the upper end of said folder.

19. A glued folder as in claim 14 wherein said main display panel includes a first aperture disposed adjacent the top edge thereof and wherein said back panel includes a second aperture disposed adjacent the top edge thereof, and aligned with said first aperture for hanging said folder while on display.

20. A glued folder as in claim 14 wherein the folder is formed from a single sheet of cardboard blank.

21. A glued folder as in claim 14 wherein the length and the width of said back panel is equal to the length and the width of said main display panel.

* * * * *